United States Patent [19]

Stone

[11] Patent Number: 4,949,899

[45] Date of Patent: Aug. 21, 1990

[54] COLLAPSIBLE, FOLDABLE DISPENSING CARTON

[75] Inventor: James L. Stone, Grand Rapids, Mich.

[73] Assignee: Packaging Corporation of America, Evanston, Ill.

[21] Appl. No.: 341,560

[22] Filed: Apr. 21, 1989

[51] Int. Cl.[5] ..... B65D 5/66

[52] U.S. Cl. ..... 229/125.09; 229/125.14; 229/125.15; 229/917

[58] Field of Search ..... 229/125.08, 128.09, 229/125.14, 125.15, 125.17, 917

[56] References Cited

U.S. PATENT DOCUMENTS

| | | | |
|---|---|---|---|
| 2,826,348 | 3/1958 | Schroeder et al. | 229/125.09 |
| 2,927,695 | 3/1960 | Bartolomeo | 229/125.09 |
| 3,162,100 | 12/1964 | Rein et al. | 229/125.09 |
| 4,732,315 | 3/1988 | Gunn | 229/125.09 |
| 4,782,996 | 11/1988 | Spahni, Jr. | 229/125.09 |
| 4,852,764 | 8/1989 | Stone | 229/125.15 |
| 4,858,793 | 8/1989 | Stone | 229/125.09 |
| 4,880,155 | 11/1989 | Stone | 229/125.09 |

*Primary Examiner*—Gary E. Elkins

*Attorney, Agent, or Firm*—Neuman, Williams, Anderson & Olson

[57] ABSTRACT

A collapsible foldable dispensing carton is provided which includes pairs of first and second top closure flaps foldably connected to upright wall panels, the latter being foldably interconnected. When the carton is in a set up mode, pairs of wall panels are in spaced, opposed relation. When the closure flaps are in an overlapping close relation, one of the first flaps is the outermost flap and is provided with a dispensing opening. A fitment of thin material is mounted on an exposed surface of the outermost flap and in registry with the dispensing opening. The fitment includes a base section which is affixed to the exposed surface portion of the outermost first flap circumjacent the dispensing opening. The base section is provided with an aperture in registry with the dispensing opening. The fitment also includes a hingedly mounted cover section movable relative to the base section between fully open and close modes. The hinge axis of the cover section is in alignment with a peripheral segment of the outermost flap and in spaced, parallel relation with a foldline connecting the outermost flap to one upright wall panel.

8 Claims, 1 Drawing Sheet

COLLAPSIBLE, FOLDABLE DISPENSING CARTON

BACKGROUND OF THE INVENTION

Collapsible, foldable paperboard or corrugated fiberboard cartons have been utilized for many years for dispensing various granulated products such as detergents, soaps, and the like. Cartons of this general type are disclosed in U.S. Pat. Nos. 4,782,996; 4,732,315. In the '996 patented construction, the inner major closure flap is provided with a pair of cutouts, one being aligned with the fitment mounted on the outer major closure flap when the carton is set up. The other cutout is aligned with the fitment when the carton is in a collapsed state. In the latter situation, the thickness of the collapsed carton is substantially uniform and thus, facilitates automatic feeding of a plurality of collapsed carton into a high speed automatic set up and filling apparatus. Such apparatus is commonly used in commercial filling lines. The utilization of a pair of cutouts "in the inner major closure flap, is possessed of certain disadvantages, such as: (a) the area of adhesive bond between the major flaps, when the flaps are in overlapping close relation, is reduced; (b) there is an increased amount of waste of the paperboard material of which the carton is formed because of the extra cutout in the inner major closure flap; and (c) some difficulty mi9ht be experienced in ali9nin9 one of the cutouts with the fitment when the carton is in a collapsed state.

In lieu of the pair of cutouts being formed in the inner major flap, the '315 patented construction utilizes one or more of the following features to compensate for the added thickness of the collapsed carton resulting from the fitment engaging the inner major flap: (a) certain of the score lines are fluffed; (b) forming of embossments 43 on certain panels of the collapsed carton which engage one another; and (c) a novel way of folding the glue flap to increase the thickness thereof. Such features, however, require special folding, scoring or embossing equipment which increases the complexity and cost of forming and setting up the carton.

SUMMARY OF THE INVENTION

Thus, an improved dispensing carton is provided which avoids all of the aforenoted shortcomings besetting prior dispensing cartons of this general type.

The improved dispensing carton enables the fitment to be readily affixed to the outer major flap utilizing high speed equipment of conventional design.

Further unique and beneficial features inherent in the improved dispensing carton will become apparent from the description, accompanying drawings and appended claims.

In accordance with one embodiment of the invention, an improved collapsible, foldable, dispensing carton is provided. The carton includes a plurality of foldably connected wall panels arranged in opposed relation. Each wall panel has a top closure flap foldably connected to an upper edge portion thereof. A fitment of thin material is mounted on the outermost closure flap. The fitment includes a base section which is affixed to the exposed surface portion of the outermost flap circumjacent a dispensing opening formed in said flap. A cover section is foldably connected to a peripheral segment of the base section for movement between fully open and close positions. The folding axis of the cover section is in spaced, parallel relation to the folding connection between the outermost closure flap and a wall panel. When the cover section is in a fully open position, it is disposed outside the periphery of the outermost flap.

DESCRIPTION

For a more complete understanding of the invention reference is made to the drawings wherein.

Figure 1:
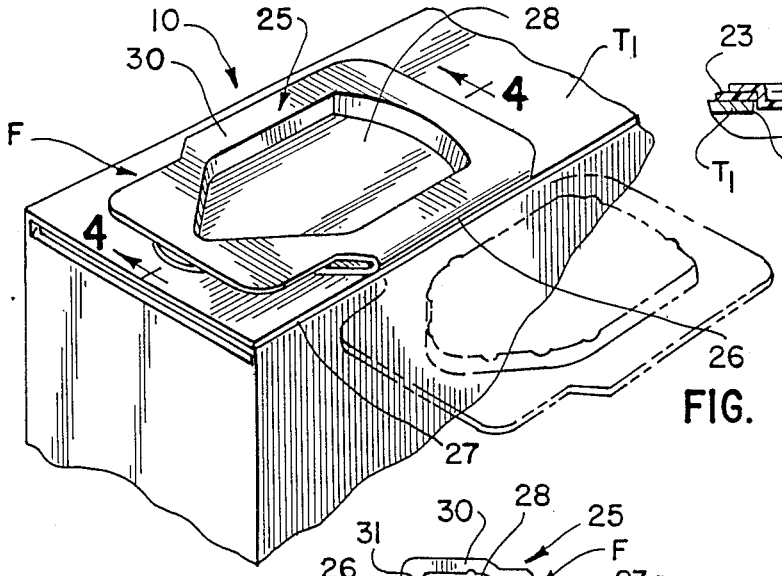
FIG. 1 is a fragmentary perspective view of the upper portion of the improved dispensing carton in a set up mode and showing in full line the fitment cover section in a fully close position; the cover section in a fully open position is shown in phantom lines.

Referring now to the drawings and more particular to FIG. 1, one embodiment of the improved dispensing carton 10 is shown which is suitable for accommodating granulated products, such as detergents, soap, certain types of dehydrated beverage products, cereals, cake flour, etc. Only a portion of the accommodated product is normally dispensed at a given time and the remainder of the product remains within the carton. The carton normally has a rectangular exterior configuration, but may take other shapes, such as a square, if desired.

The carton 10 is preferably formed from a blank 11 of suitable paperboard stock. The blank includes first and second pairs 12, 13 of wall panels wherein the panels of each pair are arranged in opposed substantially parallel relation when the carton is in the set up mode, see FIG. 1. The panels of the pairs are arranged in alternate side by side relation and are interconnected by foldlines 14. One of the end panels in the blank is provided with the conventional manufacturer's glue flap 15. In the illustrated embodiment, each panel of the first pair 12 is wider than each panel of the second pair 13. The wall panels comprising the first pair 12 are of like configuration and the same is true of the wall panels of the second pair 13. Foldably connected to the upper and lower edges of the wall panels 12 and 13 are top and bottom closure flaps, respectively. Only the top closure flaps $T_1$–$T_4$ are illustrated. The bottom closure flaps are of conventional design and form no part of the invention herein disclosed. Top closure flaps $T_1$ and $T_3$, commonly referred to as major closure flaps, are connected by foldlines 16, 17, respectively, to the upper edges of wall panels 12. In a like manner, closure flaps $T_2$ and $T_4$, commonly referred to as minor closure flaps, are connected by foldlines 18, 20, respectively, to the upper edges of wall panels 13. The foldlines 16–18, 20 are in endwise alignment with each other. When the carton 10 is in the set up mode, shown in FIG. 1, the closure flaps $T_1$–$T_4$ are in overlapping close relation whereby major flap $T_1$ is the outermost flap and is subtended by the remaining closure flaps $T_2$–$T_4$. Flap $T_3$ is normally the inner flap and is adhesively affixed to the underside of flap $T_1$ as will be described more fully hereinafter.

Flaps $T_1$ and $T_3$ are provided, respectively, with a dispensing opening 21 and a cutout 22. When the flaps are in the overlapping close relation, the opening 21 and cutout 22 are in registered relation. The opening and cutout are preferably located adjacent a corresponding narrow edge of the respective flaps, so that when the carton is in the set up mode, the opening and cutout will have corresponding peripheral portions thereof in proximity to a narrow wall panel 13. The corresponding peripheral portions are shaped so as to form a tapered pour spout. Major closure flaps $T_1$ and $T_3$ in the illustrated embodiment, span the distances, between each pair of wall panels 12 and 13.

Mounted on the exposed surface of flap $T_1$ is a fitment F which is preferably formed of an inexpensive thin plastic material which is inert to the contents of the carton. The fitment F includes a base section 23 which is affixed by a suitable adhesive or the like to the portion of the exposed surface of the outermost flap $T_1$ which is circumjacent the dispensing opening 21 formed therein. The fitment base section is provided with an aperture 24 which is slightly less in size than opening 21 but has a shape similar to that of the opening. One peripheral segment **23*a* of the base section 23 is connected to a cover section 25 by a foldline 26, the latter being in alignment and superposed relative to the free edge 27 of closure flap $T_1$ when the base section 23 is affixed to the exposed surface of flap $T_1$. The foldline 26 of the fitment F is disposed in spaced, parallel relation with the foldline 16 connecting flap $T_1$ to the upper edge of panel 12**.

Figure 5:
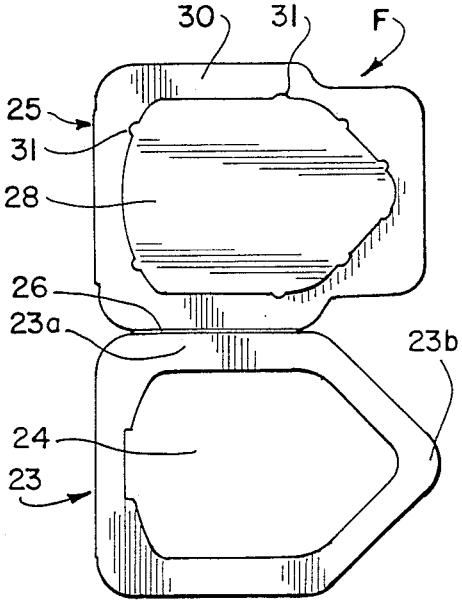
FIG. 5 is an enlarged view of the fitment of FIG. 1 with the cover section thereof in a fully open position.

The cover section 25 includes a centrally disposed protuberance 28 which is encompassed by a marginal portion 30. The shape of the protuberance corresponds substantially to the shape of aperture 24 formed in the base section so that, when the cover section 25 is in the close mode, the protuberance will frictionally engage the perimeter of aperture 24. To enhance the frictional engagement, the protuberance may be provided with a plurality of relatively spaced nubs 31 which extend laterally from the sides of the protuberance, see FIG. 5.

Figure 4:
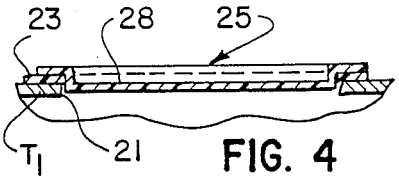
FIG. 4 is an enlarged fragmentary sectional view taken along line 4—4 of FIG. 1.
Figure 2:
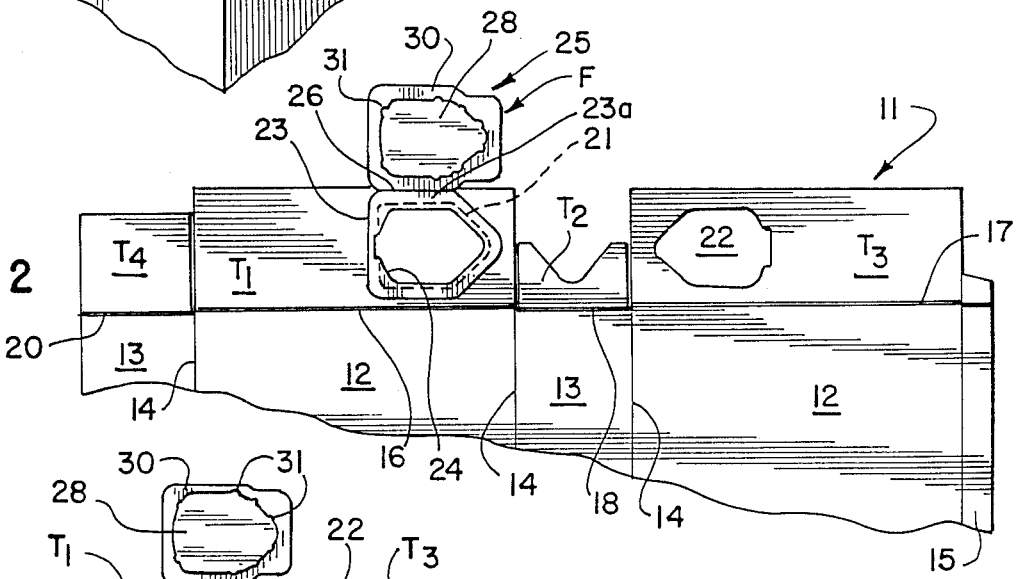
FIG. 2 is a fragmentary top view of a blank from which the carton of FIG. 1 is formed; the fitment of FIG. 1 in a fully open position is shown mounted on one of the major top closure flaps which forms the outermost flap when the closure flaps are in overlapping relation.

As will be noted in FIG. 4, the protuberance 28 projects into the aperture 24 formed in the base section and thus, prevents leakage and/or infestation of the carton contents. The perimetric, or circumjacent, portion **23*b* of base section, which defines the aperture 24, extends a short distance beyond the perimeter of the dispensing opening 21** formed in closure flap $T_1$. Thus, when the cover section is in the close mode, there is a positive frictional engagement between the cover and base sections rather than between the cover section and the paperboard of the closure flap.

Figure 3:
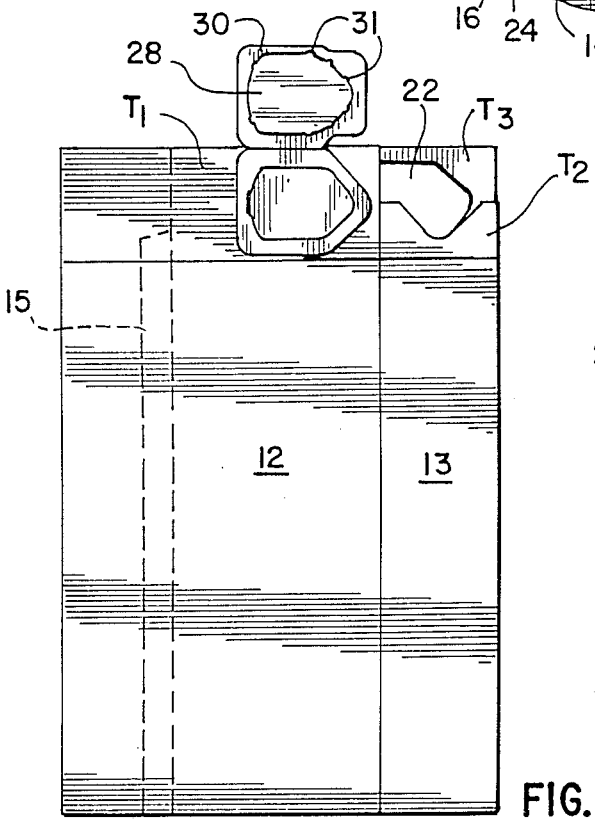
FIG. 3 is a fragmentary view of the upper portion of the carton when in a collapsed mode prior to being set up and filled.

It will be noted in FIG. 3 when the carton is in the initial collapsed mode, the cover section 25 assumes a fully open position or mode and is disposed outside the periphery of both flaps $T_1$ and $T_3$ and thus, there is no engagement between the cover section and a closure flap which might otherwise cause an increase thickness of the collapsed carton in the area of such engagement. Such increased thickness is to be avoided, as it becomes a problem when a plurality of collapsed cartons are arranged in a stack wherein one side of the stack builds up as compared to an opposing side of the stack. As aforementioned, the carton structure disclosed in U.S. Pat. No. 4,732,315, overcomes this thickness differential by utilizing fluffed score lines, contacting embossments, and/or folding the glue flap in a unique way.

Thus, an improved dispensing carton has been provided which is of a simple, inexperience design; avoids the problems of a collapsed carton having thickness differentials; and the fitment can be readily mounted on the carton blank by utilizing high speed equipment of conventional design.

I claim:

1. A collapsible foldable dispensing carton comprising a pair of opposed first wall panels; a pair of opposed second wall panels, the wall panels of said pairs being interposed and foldably interconnected to one another; a pair of top closure first flaps foldably connected to upper edges of said first wall panels; a pair of top closure second flaps foldably connected to upper edges of said second wall panels, said first and second flaps being in overlapping close relation when said carton is in a set up mode whereby one first flap is an outermost flap and is provided with a dispensing opening and one of the other flaps is provided with means whereby the dispensing opening is in communication with the interior of the carton, when the latter is in the set up mode and the flaps are in the close relation; and a fitment of thin material mounted on an exposed surface of the outermost flap and in registry with the dispensing opening, said fitment including a base section affixed to a predetermined portion of the exposed surface circumjacent the dispensing opening, said base section being provided with an aperture in registry with the dispensing opening, and a cover section mounted for hinged adjustment relative to said base section between fully open and close modes, said cover section, when in a fully open mode, being disposed substantially outside the periphery of the outermost top closure flap to which said base section is affixed.

2. The dispensing carton of claim 1 wherein the carton, when in a set up mode, has a substantial rectangular configuration and the outermost first flap substantially spans the distance between the pairs of first and second wall panels when said top closure flaps are in close relation.

3. The dispensing carton of claim 1 wherein, when the carton is in a collapsed mode and the fitment cover section is in a fully open mode, the cover section is not in an overlapping relation with any top closure flap.

4. The dispensing carton of claim 1 wherein the fitment cover section has a hinge axis disposed in spaced substantially parallel relation with respect to a foldline connecting the outermost first flap to a first wall panel upper edge.

5. The dispensing carton of claim 4 wherein the hinge axis of the fitment cover section is substantially aligned with a peripheral segment of the outermost first flap on which the fitment is mounted.

6. The dispensing carton of claim 2 wherein the other first flap is only provided with a dispensing cutout, the latter being in registry with the dispensing opening of the outermost flap and the base section aperture when said flaps are in overlapping close relation.

7. The dispensing carton of claim 1 wherein the fitment cover section includes a protuberance projecting into and closing the base section aperture when said cover section is in the close mode, and a marginal portion substantially encompassing said protuberance and extending laterally outwardly therefrom, said marginal portion, when in a close mode, overlying the portion of said base section defining the aperture, peripheral segments of the marginal portion and the aperture - defining portion of the base section being interconnected by a first foldline forming the cover section hinge axis, the latter being in spaced, substantially parallel relation with a second foldline connecting the outermost first flap with the upper edge of a first wall panel.

8. The dispensing carton of claim 1 wherein, when the flaps are in an overlapping close relation, the dispensing opening of the outermost first flap is in registry with a cutout formed in the other first flap and providing said communication to the carton interior.

* * * * *